US007145514B2

(12) United States Patent
Lachenmaler et al.

(10) Patent No.: US 7,145,514 B2
(45) Date of Patent: Dec. 5, 2006

(54) SUBSTRATE ELEMENT WITH INTEGRATED ANTENNA STRUCTURE

(75) Inventors: Axel Lachenmaler, Rudersberg (DE); Andreas Brunner, Uhingen (DE); Joachim Flaig, Kongen (DE); Markus Schafer, Rudersberg (DE); Hans-Joachim Ludwig, Neckartenzlingen (DE); Markus Pfletschinger, Eningen (DE); Martin Kuhn, Stuttgart (DE)

(73) Assignees: Decoma (Germany) GmbH, Sulzbach (DE); Hirschmann Electronics GmbH & Co KG, Neckartenzlingen (DE)

( * ) Notice: Subject to any disclaimer, the term of this patent is extended or adjusted under 35 U.S.C. 154(b) by 11 days.

(21) Appl. No.: 10/932,171

(22) Filed: Sep. 1, 2004

(65) Prior Publication Data

US 2005/0078041 A1 Apr. 14, 2005

(30) Foreign Application Priority Data

Sep. 1, 2003 (DE) ..... 103 40 590

(51) Int. Cl.
*H01Q 1/32* (2006.01)

(52) U.S. Cl. ..... 343/711; 343/713; 340/572.5

(58) Field of Classification Search ..... 343/700 MS, 343/711, 713, 850, 876; 340/447, 572.5, 340/572.7

See application file for complete search history.

(56) References Cited

U.S. PATENT DOCUMENTS

| | | | | |
|---|---|---|---|---|
| 5,400,039 | A * | 3/1995 | Araki et al. | 343/700 MS |
| 5,402,134 | A | 3/1995 | Miller et al. | 343/742 |
| 6,275,157 | B1 * | 8/2001 | Mays et al. | 340/572.5 |
| 6,353,415 | B1 * | 3/2002 | Ashtiani et al. | 343/713 |
| 6,633,260 | B1 * | 10/2003 | Paschen et al. | 343/700 MS |

FOREIGN PATENT DOCUMENTS

| | | |
|---|---|---|
| DE | 195 35 250 A1 | 9/1995 |
| DE | 100 25 931 A1 | 5/2000 |
| EP | 0 221 694 A2 | 10/1986 |
| EP | 1 087 464 A2 | 9/2000 |
| EP | 1 337 004 A2 | 2/2003 |

OTHER PUBLICATIONS

Patent Abstacts of Japan 62102604, application No. 60243609, date of filing Oct. 29, 1985, Antenna System for Automobile, Toyota Motor Corporation, Inventor: OE Junzo Kondo Hiroshi.

* cited by examiner

*Primary Examiner*—Tuyet Vo
*Assistant Examiner*—Jimmy Vu
(74) *Attorney, Agent, or Firm*—Clark Hill PLC

(57) ABSTRACT

A method of producing an antenna structure for an automotive vehicle comprising the steps of providing a substrate element and arranging the antenna structure on one surface of the substrate element.

11 Claims, 2 Drawing Sheets

SUBSTRATE ELEMENT WITH INTEGRATED ANTENNA STRUCTURE

FIELD OF THE INVENTION

The invention relates to a method of producing an antenna structure for an automotive vehicle, and to an antenna structure for an automotive vehicle.

DESCRIPTION OF THE RELATED ART

In current automotive engineering, it is no longer possible to imagine the automotive vehicle without antennae. In addition to the conventional audio appliances in the form of radios, modern automobiles furthermore have mobile-radio devices, GPS systems, television sets or further special fittings, such as, for example, a radio central locking system or the like. All these fittings make a suitable antenna necessary, and this currently has the result that the numerous antennae or antenna systems in the vehicle are distributed at various points. In addition to conventional rod aerials, it is known to integrate antennae into the windscreen or rear window or to provide them at other points that ensure a good reception. The known car antennae systems are subject, however, to the disadvantage that, as a consequence of the distribution of the antennae at various points, the length of the cable connections to the vehicle distribution system is high and the respective cable harnesses are correspondingly complex. Furthermore, manual fitting of the individual antenna structures in the vehicle is very time-consuming and, consequently, expensive.

Correspondingly, the underlying object of the invention is to provide an antenna structure for an automotive vehicle that permits an easy and rapid mounting in the automotive vehicle together with an economical production.

SUMMARY OF THE INVENTION

The method of producing an antenna structure for an automotive vehicle in accordance with the invention comprises the steps of providing a substrate element, and arranging the antenna structure on one surface of the substrate element.

In an embodiment of the method according to the invention the antenna structure is applied by an etching method to one surface of the substrate element.

In an alternative embodiment of the method according to the invention, the antenna structure is applied to one surface of the substrate element by a lithographic method, by an evaporation method, by a sputtering method, by depositing a conductive ink, or by depositing a silver paste or the like.

In a further possible embodiment of the method according to the invention the antenna structure has contact means which may be deposited on the surface of the substrate element as a defined contact point.

According to a further possible embodiment of the method according to the invention the method comprises the steps of mounting the substrate element on a bodywork component of the automotive vehicle by means of force-locked and/or shape-locked attachment means, the contact means of the antenna structure being connected to a distribution system of the automotive vehicle for the purpose of signal transmission.

In a possible embodiment of the method according to the invention the substrate element is mounted on one side of the bodywork component, which side is opposite an outside of the vehicle, the bodywork component not being electrically conductive. Further, the bodywork component may be a planar bodywork component, such as, a particular, a roof module, a boot lid or the like. Still further, the contact point of the antenna structure may be in contact connection with contact means formed matchingly thereto on the bodywork component in the case of the substrate element being mounted.

The antenna structure in accordance with the invention is disposed on a substrate element that is mounted as such on a bodywork component. Any known shape-locked and/or force-locked joints, for example in the form of clip joints or plug joints, gluing, screwing and the like, are suitable for mounting the substrate element. The substrate element may preferably be formed from a support sheet, which can be produced particularly inexpensively, for example in the form of a thermoplastic sheet.

The substantial advantage of the antenna structure in accordance with the invention is that the antenna structure as such is already disposed in its entirety on the substrate element before the substrate element is mounted on a bodywork component. Since the possibly complex and time-consuming steps of producing the antenna structure on the substrate element have already been completed in the preliminary stages of the mounting, fitting to the bodywork component itself can be performed in a very time-saving way on the assembly line.

In an advantageous refinement of the invention, the antenna structure is applied on the surface of the substrate element. The antenna structure can be formed on the surface of the substrate element using known methods for producing surface structures, such as, for example, an evaporation and/or sputtering method in combination with a lithographic and/or an etching method. As an alternative to this, the antenna structure can also be formed by depositing conductive ink or silver paste or similar conductive materials on the surface of the substrate element. Further details on the formation of the antenna structure on the substrate element or on the surface of the substrate element are explained below.

In a further advantageous refinement of the invention, the antenna structure comprises contact means that are in contact connection with corresponding contact means on the bodywork component for signal transmission so that the antenna structure is suitably connected to the vehicle distribution system of the automotive vehicle.

The mounting of the substrate element and making contact, necessary in this connection, of the terminals of the antenna structure is advantageously ensured by defined contact points that are deposited on the surface of the substrate element. The bodywork component to which the substrate element is attached has correspondingly contact means that are formed to match the defined contact points and that are in contact abutment with the contact points of the antenna structure in the mounted substrate element. Preferably, the defined contact points of the antenna structure are formed on the surface of the substrate element as reinforced pads or the like that may have a slightly raised contour with respect to the surface of the substrate element for fault-free signal transmission so that they can reliably come into contact with the contact means of the bodywork component.

In an advantageous refinement of the invention, the support part is mounted on one side of the bodywork component, which side is opposite to an outside of the automotive vehicle, the bodywork component not being electrically conductive. Such a structure of the bodywork part advantageously ensures that an undesirable screening of the antenna structure does not occur. In addition, such a fitting of the substrate element on the explained side of the bodywork component ensures that the antenna structure is not damaged by environmental factors or the like that prevail on the outside of the vehicle.

In an advantageous refinement of the invention, the bodywork component on which the substrate element is mounted has a planar structure, in which connection, the bodywork component may preferably be a roof module, a boot lid or the like. Such bodywork components offer a sufficiently large surface even for complex antenna structures so that the various individual parts or additional parts of the antenna structure can be disposed next to one another on the substrate element, and this advantageously results in a smaller overall height. If the abovementioned roof module, the boot lid or the like is made of a plastic that is not electrically conducting, an excellent signal reception is easily ensured for the antenna structure.

Further advantages and configurations of the invention emerge from the description and the accompanying drawing.

It goes without saying that the abovementioned features and those still to be explained below can be used not only in the respective specified combination, but also in other combinations or on their own without departing from the scope of the present invention.

The invention is schematically shown in the drawings with reference to an embodiment and is described in detail below with reference being made to the drawing.

DETAILED DESCRIPTION OF DRAWINGS

Figure 1:
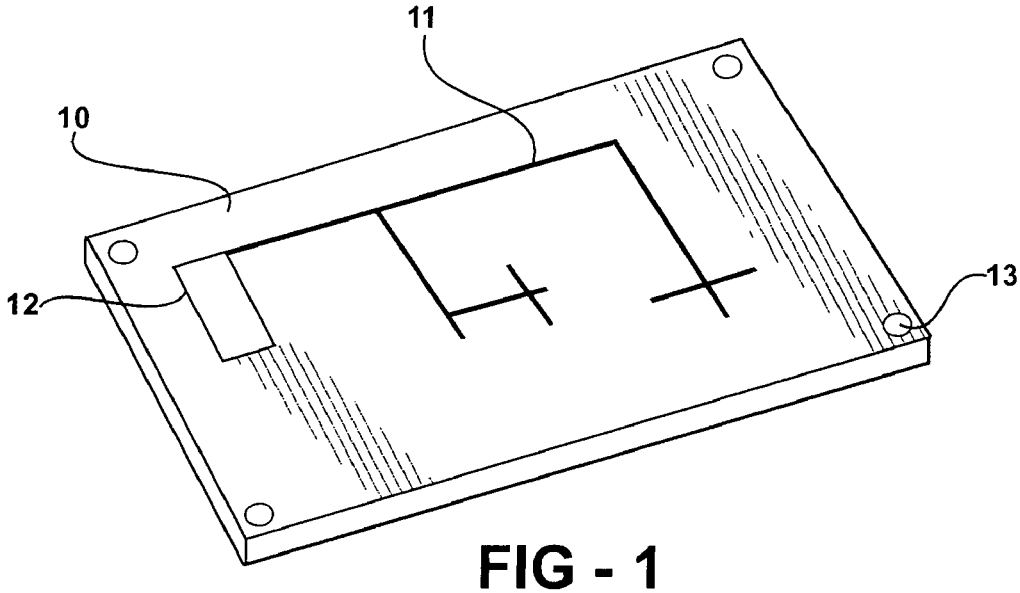
FIG. 1 shows a perspective view of a substrate element on which the antenna structure in accordance with the invention is disposed.

In a very simplified view, FIG. 1 shows, in perspective, a substrate element 10 on which an antenna structure 11 in accordance with the invention is disposed. In detail, the antenna structure is integrated in the substrate element, i.e. it is applied to a surface of the substrate element. The substrate element 10 preferably comprises a support sheet, for example a thermoplastic sheet. Such a thermoplastic sheet can be back-formed or back-filled with a further plastic on the side that is opposite the antenna structure. Suitable for this purpose are back-forming with a PUR system, back-moulding with a thermoplastic material or, alternatively, back-embossing with a glass mat thermoplastic (GMT) or sheet-moulding-compound (SMC) material so that the support sheet can endow sufficient mechanical properties. As an alternative to this, that side of the substrate element may also be back-formed or back-filled to which the antenna structure is applied.

Diverse known methods of producing surface structures are suitable for applying the antenna structure 11 to a surface of the substrate element 10. A few of these methods are explained by way of example below.

In general, a conductor layer is applied, for example by means of the evaporation or sputtering method, to the surface of the substrate element 10. To apply a metal or a conductive layer on the surface of the substrate element, a known vacuum reactor comprising a suitable evaporation device is used as a rule, and this is shown in a simplified basic cross-sectional elevation in FIG. 3.

An evaporation device 30 in the form of the vacuum reactor has a bell jar 31 within which a specimen, such as, for example, the substrate element 10 is disposed or is horizontally suspended. From a side wall 32 of the bell jar 31, a tube 33 branches off outwards in which a pump device 34 or the like is installed. A reduced pressure can be produced inside the vacuum reactor 30 when the pump device 34 is operated. Furthermore, a so-called boat 35 is disposed inside the bell jar 31 and underneath the point at which the substrate element 10 is disposed. If, for example, aluminium is applied to the substrate element 10 as the conductive layer, the boat 35 is provided with an aluminium wire (not shown) that is evaporated by means of a heating device, an electron beam or the like.

The patterning of the conductive layer on the substrate element 10 is preferably achieved with the aid of a so-called "resist", i.e. polymer that is, as a rule, radiation sensitive. In the so-called "lift-off process", the resist is applied to the substrate element 10 earlier in time than the conductive layer and the resist is applied on the conductive layer already previously disposed on the substrate element in the so-called "etching method", the conductive layer then being subjected to an etching process.

In the "lift-off process", the resist 41 (FIG. 4*a*) is first applied to the surface of the substrate element 10. Suitable irradiation, for example UV, X-ray, ion or electron radiation, alters the properties of the resist 41 in a controlled way at the exposed points.

This makes possible a selective removal of the irradiated (positive method) or of the unirradiated regions (negative method). Suitable for producing the desired antenna structure is, for example, UV lithography, with which structures in the micrometer range can readily be obtained. A working mask through which the resist 41 is exposed is, as a rule, used in this type of lithography. As an alternative to this, the exposure of the resist may also be performed by means of so-called electron beam lithography. In this technique, an electron beam is used to pattern the resist layer. An advantage of this method is, in addition to the high resolution, the great flexibility of this patterning method since, for example, in contrast to UV lithography, no masks are needed since any desired structures can be produced as a CAD file or directly on the resist to be irradiated by means of suitable control software.

Figure 4A:
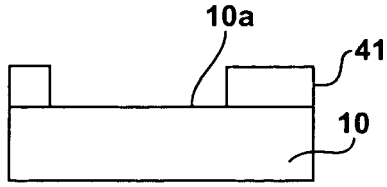
FIGS. 4*a*–4*c* illustrate the production of the antenna structure in accordance with the invention in accordance with the so-called "lift-off process".
Figure 4B:
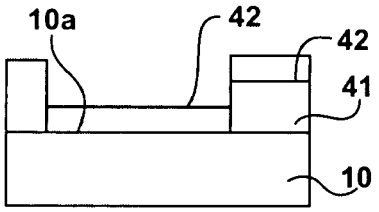
Figure 4C:
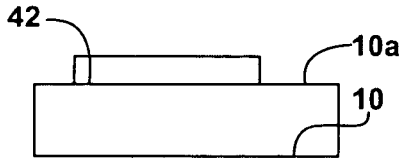

As a result of the lithography, some regions of the resist 41 are selectively removed. The remaining layer of the resist 41 consequently has the function of protecting the material of the substrate element 10 underneath it against the effects of the subsequent application of a conductive layer. Expressed in other words, only those regions of the substrate element 10 at which parts of the resist have been removed are coated with a conductive layer in the evaporation method already explained above. FIGS. 4*a* to 4*c* show the sequence of these steps in the method according to the lift-off process in a simplified basic sketch.

FIG. 4*a* shows a cross-sectional side elevation of the substrate element 10 to whose surface 10*a* the radiation-sensitive resist 41 is applied. In the diagram of 4*a*, the resist 41 has already been subjected to lithography, as explained above, with the result that, for example, a central region of the resist has been removed and, consequently, the underlying surface 10*a* of the substrate element 10 has been exposed.

In a subsequent step, the substrate element is subjected to an evaporation method (cf. explanation of FIG. 3), as a result of which one surface 10*a* of the substrate element 10 is coated with a conductive layer 42. As shown in FIG. 4*b*, the conductive layer 42 is applied in the same way to the remaining regions of the resist 41 as also to the exposed part of the surface 10*a* of the substrate element 10. Subsequent thereto, as shown in FIG. 4*c*, the remaining part of the resist 41 and together therewith the conductive layer 42 disposed thereon is removed in a suitable way. As a result, there remains behind on the surface 10*a* of the substrate element 10 a part of the conductive layer 42 that forms the antenna structure 11 as desired. In the case of the positive method, precisely those regions of the resist that correspond to the later antenna structure 11 on the substrate element 10 have already been irradiated and thereby selectively removed during the irradiation of the resist by means of the above-mentioned lithography.

Figure 5A:
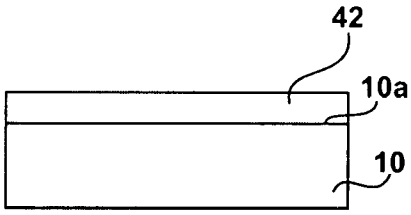
FIGS. 5*a*–5*d* illustrate the production of the antenna structure in accordance with the invention in accordance with an etching method.

As an alternative, the antenna structure can also be suitably produced by the etching method. In that case, the surface 10*a* of the substrate element 10 is first completely coated with a suitable conductive layer 42 or a metal. The substrate element 10 is shown in such a state in a simplified cross-sectional side elevation in FIG. 5*a*.

Figure 5B:
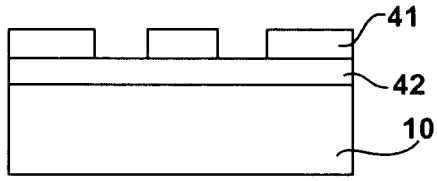
Figure 5C:
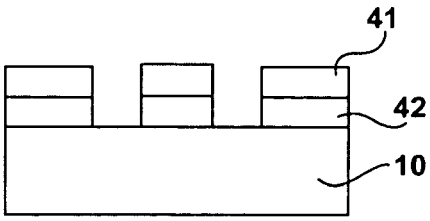
Figure 5D:
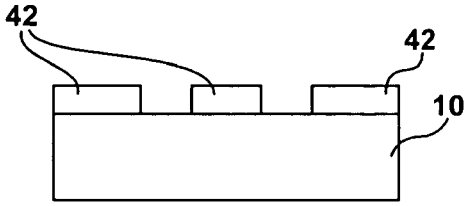

In a subsequent step in the method, as explained above, the irradiation-sensitive resist 41 is applied to the surface 10*a* or on the conductive layer 42 in the same way and selectively removed by means of a suitable lithographic method so that the conductive layer 42 is exposed to the outside at these points. This state of the substrate element 10 is shown in FIG. 5*b*. Subsequent thereto, in accordance with the diagram of FIG. 5*c*, an etching method is performed, with the result that the conductive layer 42 is substantially completely removed in those regions in which it is not covered by the resist 41. A dry etching method with which a high anisotropy and, consequently very sharp structures can be produced in the mask region is preferably suitable for performing the etching method. In detail, the dry etching method can be performed by a known chemical etching or a known physical etching. As an alternative to this, a known wet-chemical method is in principle also possible for etching the conducting layer 42.

In a final step in the method, those regions of the resist 41 that are formed on the conducting layer 42 are removed in conjunction with the etching method. As a result, only isolated regions of the conducting layer 42 that ultimately form the desired antenna structure 11 consequently remain behind on the surface 10*a* of the substrate element.

Figure 3:
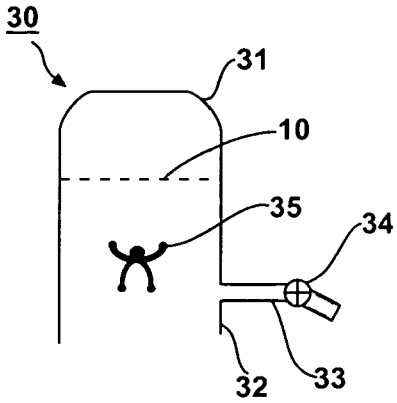
FIG. 3 illustrates the performance of an evaporation process for producing the antenna structure in accordance with the invention.

As a departure from the steps in the method explained with reference to FIGS. 3 and 4, the antenna structure can be deposited in the same way on the surface 10*a* of the substrate element 10 in the form of a conductive ink. In view of the high precision always required and simultaneously favorable production costs, a dispensing device can in this case be used that is preferably guided, for example, by means of a robot or the like and from which the conductive ink is dispensed. Instead of a conductive ink, a silver paste or a similar conductive material can be used in the same way, as a result of which the antenna structure 11 is provided on the surface 10*a* of the substrate element 10.

The antenna structure 11 furthermore comprises contact means in the form of a contact pad 12 that is likewise applied to the surface of the substrate element 10. The contact pad 12 serves to suitably connect the antenna structure 11 to a vehicle distribution system of an automotive vehicle in order to ensure signal transmission to various terminal appliances such as a radio, television set, GPS system, mobile-radio system or the like.

To mount the substrate element 10 on a bodywork component, a plurality of through bores 13, for example, may be provided in each of the corners of the substrate element 10 with which the substrate element 10 can be suitably screwed to the bodywork component. However, other ways of mounting the substrate element 10 on the bodywork components are equally possible. Thus, the substrate element 10 may also be attached to the bodywork component by gluing, clipping or the like.

Figure 2:
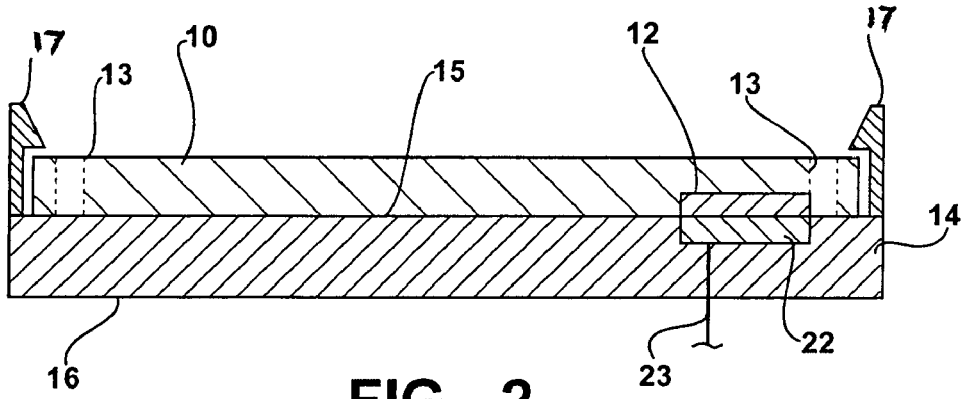
FIG. 2 shows a cross-sectional side elevation of a substrate element with an antenna structure integrated therein in a state in which the substrate element is mounted on a bodywork component.

FIG. 2 shows the substrate element 10 with the antenna structure 11 integrated therein in a state in which it is mounted on a bodywork component 14. This figure illustrates only the principle of mounting the substrate element and is accordingly a considerably simplified diagram. The substrate element 10 substantially flushly abuts one side 15 of the bodywork component 14, which side 15 is opposite an outside 16 of the vehicle. If the bodywork component is, for example, a roof module made of plastic, the substrate element 10 is correspondingly attached to an inside of the roof module so that the substrate element 10 is not exposed to environmental factors and the like.

To attach the substrate element 10 to the bodywork component 14, snap hooks 17, for example, may be fitted to the bodywork component. The snap hooks 17 advantageously engage around a respective rim of the substrate element 10 so that, after being pressed against the side 15 of the bodywork component 14, the substrate element 10 can suitably latch in position by means of the snap hooks 17. In addition or alternatively, the substrate element 10 may be screwed to the bodywork component 14 by means of through bores 13. Gluing the substrate element 10 to the side 15 of the bodywork component 14 with suitable and preferably rapidly curing adhesives is equally possible.

The bodywork component 14 has contact means 22 that are formed on the side 15, for example, in the form of a conductive contact. The contact 22 is connected by means of an electrical line 23 to a cable harness or to the vehicle distribution system of the automotive vehicle. The substrate element 10 is suitably mounted on the side 15 of the bodywork component 14 in such a way that the contact pad 12 of the antenna structure 11 abuts the contact 22. In this state shown in FIG. 2, an interference-free contact is ensured of the antenna structure 11 with the distribution network of the automotive vehicle via the contact pad 12, with the result that an excellent signal transmission is ensured to the respective terminal appliances in the automotive vehicle, for example a radio, GPS system, a mobile-radio system, radio device for central locking and the like.

The above-described embodiments of the invention are intended to be examples of the present invention and numerous modifications, variations, and adaptations may be made to the particular embodiments of the invention without departing from the scope of the invention, which is defined in the claims.

The invention claimed is:

1. A method of producing an antenna structure for an automotive vehicle comprising the steps of:

providing a substrate element, arranging the antenna structure on one surface of the substrate element, wherein the antenna structure has an electrically conductive contact deposited on the surface of the substrate element for connection to a distribution system of the automotive vehicle for the purpose of electrical signal transmission;

mounting the substrate element on one side of a bodywork component of the automotive vehicle opposite an outside of the vehicle, wherein the bodywork component is not electrically conductive, and electrically connecting the contact of the antenna structure with an electrically conductive contact matingly formed on the bodywork component.

2. A method according to claim 1, in which the antenna structure is applied by an etching method to one surface of the substrate element.

3. A method according to claim 1, in which the antenna structure is applied to one surface of the substrate element by a lithographic method.

4. A method according to claim 1, in which the antenna structure is applied to one surface of the substrate element by an evaporation method.

5. A method according to claim 1, in which the antenna structure is applied to one surface of the substrate element by a sputtering method.

6. A method according to claim 1, in which the antenna structure is applied to one surface of the substrate element by depositing a conductive ink.

7. A method according to claim 1, in which the antenna structure is applied to one surface of the substrate element by depositing silver paste or the like.

8. An antenna structure for an automotive vehicle that is disposed on a substrate element formed of a thermoplastic support sheet, said antenna structure including an electrically conductive contact deposited on the surface of the substrate element for connection to a distribution system of the automotive vehicle for the purpose of electrical signal transmission, said substrate element mounted on one side of a bodywork component of the automotive vehicle opposite an outside of the vehicle, wherein the bodywork component is not electrically conductive, and said bodywork component including an electrically conductive contact matingly connected with said contact of said antenna structure for providing an electrical connection therebetween.

9. An antenna structure according to claim 8, wherein the bodywork component is a planar bodywork component.

10. An antenna structure according to claim 9, wherein the planar bodywork component is produced from a plastic that is not electrically conducting.

11. An antenna structure according to claim 10, wherein the planar bodywork component includes a plurality of snap hooks for engaging and connecting said substrate thereto.

* * * * *

UNITED STATES PATENT AND TRADEMARK OFFICE

CERTIFICATE OF CORRECTION

PATENT NO. : 7,145,514 B2
APPLICATION NO. : 10/932171
DATED : December 5, 2006
INVENTOR(S) : Lachenmaler et al.

It is certified that error appears in the above-identified patent and that said Letters Patent is hereby corrected as shown below:

On the title page (item 75)

Please delete “Lachenmaler” and replace with --Lachenmaier--

Delete “Rudersberg” and replace with --Rudensberg--

Signed and Sealed this

Twenty-seventh Day of February, 2007

JON W. DUDAS
*Director of the United States Patent and Trademark Office*